US011050161B2

(12) United States Patent
Yman et al.

(10) Patent No.: US 11,050,161 B2
(45) Date of Patent: Jun. 29, 2021

(54) ANTENNA FEEDING NETWORK COMPRISING COAXIAL LINES WITH INNER CONDUCTORS CONNECTED BY SNAP-ON FINGERS AND A MULTI-RADIATOR ANTENNA FORMED THEREFROM

(71) Applicant: CELLMAX TECHNOLOGIES AB, Kista (SE)

(72) Inventors: Niclas J. Yman, Ekerö (SE); Stefan Jonsson, Sollentuna (SE); Dan Karlsson, Sollentuna (SE)

(73) Assignee: Cellmax Technologies AB, Kista (SE)

( * ) Notice: Subject to any disclaimer, the term of this patent is extended or adjusted under 35 U.S.C. 154(b) by 404 days.

(21) Appl. No.: 15/760,609

(22) PCT Filed: Sep. 15, 2016

(86) PCT No.: PCT/SE2016/050868
§ 371 (c)(1),
(2) Date: Mar. 15, 2018

(87) PCT Pub. No.: WO2017/048185
PCT Pub. Date: Mar. 23, 2017

(65) Prior Publication Data

US 2020/0227834 A1 Jul. 16, 2020

(30) Foreign Application Priority Data

Sep. 15, 2015 (SE) ..... 1551183-5

(51) Int. Cl.
*H01Q 21/00* (2006.01)
*H01P 3/06* (2006.01)
(Continued)

(52) U.S. Cl.
CPC ..... *H01Q 21/0006* (2013.01); *H01P 3/06* (2013.01); *H01P 5/026* (2013.01); *H01P 5/12* (2013.01);
(Continued)

(58) Field of Classification Search
CPC ..... H01P 3/06; H01P 5/12; H01P 21/0006
(Continued)

(56) References Cited

U.S. PATENT DOCUMENTS 4,401,955 A * 8/1983 Yorinks et al. ..... H01P 5/12 333/127
5,801,600 A 9/1998 Butland et al.
(Continued)

FOREIGN PATENT DOCUMENTS

CN 102714354 A 10/2012
EP 0575808 A1 12/1993
(Continued)

OTHER PUBLICATIONS

PCT/SE20161050863, International Search Report, dated Dec. 16, 2016, Patent-och registreringsverket Box 5055 S-102 42 Stockholm, Sweden. 106.009.
(Continued)

*Primary Examiner* — Benny T Lee
(74) *Attorney, Agent, or Firm* — The Jansson Firm; Pehr B. Jansson

(57) ABSTRACT

An antenna feeding network for a multi-radiator antenna, the antenna feeding network comprising at least two coaxial lines. Each coaxial line comprises a central inner conductor and an elongated outer conductor surrounding the central inner conductor. At least a first inner conductor and a second inner conductor of the at least two coaxial lines are indirectly interconnected.

24 Claims, 4 Drawing Sheets

(51) Int. Cl.
*H01Q 21/26* (2006.01)
*H01P 5/12* (2006.01)
*H01P 5/02* (2006.01)

(52) U.S. Cl.
CPC ..... *H01Q 21/0087* (2013.01); *H01Q 21/26* (2013.01)

(58) Field of Classification Search
USPC ..... 333/245, 127
See application file for complete search history.

(56) References Cited

U.S. PATENT DOCUMENTS

| | | | | |
|---|---|---|---|---|
| 5,994,977 | A * | 11/1999 | Taya | H01P 3/06 333/111 |
| 6,207,901 | B1 * | 3/2001 | Smith et al. | H01P 1/30 174/102 R |
| 6,683,582 | B1 | 1/2004 | Love | |
| 7,619,580 | B2 * | 11/2009 | Lenart et al. | H01P 3/06 343/830 |
| 10,424,843 | B2 * | 9/2019 | Yman et al. | H01Q 19/108 |
| 2001/0048351 | A1 | 12/2001 | Love | |
| 2002/0135520 | A1 | 9/2002 | Teillet et al. | |
| 2002/0135527 | A1 | 9/2002 | Teillet et al. | |
| 2004/0203284 | A1 | 10/2004 | Stolle et al. | |
| 2004/0263389 | A1 | 12/2004 | Haunberger et al. | |
| 2005/0134517 | A1 | 6/2005 | Gottl | |
| 2007/0241984 | A1 | 10/2007 | Schadler | |
| 2008/0139044 | A1 | 6/2008 | Hantsch et al. | |
| 2010/0001811 | A1 | 1/2010 | Haunberger et al. | |
| 2010/0007571 | A1 | 1/2010 | Riedel | |
| 2010/0201590 | A1 | 8/2010 | Girard et al. | |
| 2010/0283710 | A1 | 11/2010 | Lutman et al. | |
| 2013/0088402 | A1 | 4/2013 | Lindmark et al. | |
| 2014/0035698 | A1 | 2/2014 | Schadler et al. | |
| 2014/0139387 | A1 | 5/2014 | Jones et al. | |
| 2015/0109183 | A1 | 4/2015 | Smith | |
| 2015/0180135 | A1 | 6/2015 | Jonsson et al. | |

FOREIGN PATENT DOCUMENTS

| | | | |
|---|---|---|---|
| KR | 20100117838 | A | 11/2010 |
| WO | WO8605325 | A1 | 9/1986 |
| WO | WO02067374 | A1 | 8/2002 |
| WO | WO2005060049 | A1 | 10/2005 |
| WO | WO2005101566 | A1 | 10/2005 |
| WO | WO2006006913 | A1 | 1/2006 |
| WO | WO2009041896 | A1 | 4/2009 |
| WO | WO2012003506 | A2 | 1/2012 |
| WO | WO2012103821 | A2 | 8/2012 |
| WO | WO2014120062 | A1 | 8/2014 |
| WO | WO2017048181 | A1 | 3/2017 |
| WO | WO2017048182 | A1 | 3/2017 |

OTHER PUBLICATIONS

PCT/SE20161050863, Written Opinion of the International Searching Authority, dated Dec. 16, 2016, Patent-och registreringsverket Box 5055 S-102 42 Stockholm, Sweden. 106.009.
PCT/SE2017/050087, International Search Report, dated May 4, 2017, Patent-och registreringsverket Box 5055 S-10242 Stockholm, Sweden. 106.013.
PCT/SE2017/050087, Written Opinion of the International Searching Authority, dated May 4, 2017, Patent-och registreringsverket Box 5055 S-10242 Stockholm, Sweden. 106.013.
PCT/SE2017/050088, International Search Report, dated Apr. 28, 2017, Patent-och registreringsverket Box 5055 S-10242 Stockholm, Sweden. 106.014.
PCT/SE2017/050088, Written Opinion of the International Searching Authority, dated Apr. 28, 2017, Patent-och registreringsverket Box 5055 S-10242 Stockholm, Sweden. 106.014.
PCT/SE2017/050618, International Search Report, dated Aug. 30, 2017, Patent-och registreringsverket Box 5055 S-10242 Stockholm, Sweden. 106.015.
PCT/SE2017/050618, Written Opinion of the International Searching Authority, dated Aug. 30, 2017, Patent-och registreringsverket Box 5055 S-10242 Stockholm, Sweden. 106.015.
PCT/SE2016/050864, International Search Report, dated Nov. 30, 2016, Patent-och registreringsverket Box 5055 3-10242 Stockholm, Sweden. 106.010.
PCT/SE2016/050864, Written Opinion of the International Searching Authority, dated Nov. 30, 2016, Patent-och registreringsverket Box 5055 S-10242 Stockholm, Sweden. 106.010.
PCT/SE2016/050867, International Search Report, dated Dec. 14, 2016, Patent-och registreringsverket Box 5055 S-10242 Stockholm, Sweden. 106.011.
PCT/SE2016/050867, Written Opinion of the International Searching Authority, dated Dec. 14, 2016, Patent-och registreringsverket Box 5055 S-10242 Stockholm, Sweden. 106.011.
PCT/SE2016/050868, International Search Report, dated Dec. 16, 2016, Patent-och registreringsverket Box 5055 S-10242 Stockholm, Sweden. 106.012.
PCT/SE2016/050868, Written Opinion of the International Searching Authority, dated Dec. 16, 2016, Patent-och registreringsverket Box 5055 S-10242 Stockholm, Sweden. 106.012.

* cited by examiner

ANTENNA FEEDING NETWORK COMPRISING COAXIAL LINES WITH INNER CONDUCTORS CONNECTED BY SNAP-ON FINGERS AND A MULTI-RADIATOR ANTENNA FORMED THEREFROM

TECHNICAL FIELD

The invention relates to the field of antenna feeding networks for multi-radiator antennas, in which the feeding network comprises at least two interconnected coaxial lines.

BACKGROUND OF THE INVENTION

Multi-radiator antennas are frequently used in, for example, cellular networks. Such multi-radiator antennas comprise a number of radiating antenna elements, for example, in the form of dipoles for sending or receiving signals, an antenna feeding network and an electrically conductive reflector. The antenna feeding network distributes the signal from a common coaxial connector to the radiators when the antenna is transmitting and combines the signals from the radiators and feeds the signals to the coaxial connector when receiving. A possible implementation of such a feeding network is shown in FIG. 1.

In such a network, if the splitters/combiners consist of just one junction between 3 different 50 ohm lines, impedance match would not be maintained, and the impedance seen from each port would be 25 ohm instead of 50 ohm. Therefore, the splitter/combiner usually also includes an impedance transformation circuit that maintains 50 ohm impedance at all ports.

A person skilled in the art would recognize that signal feeding is fully reciprocal in the sense that transmission and reception can be treated in the same way, and to simplify the description of this invention only the transmission case is described below.

The antenna feeding network may comprise a plurality of parallel coaxial lines being substantially air filled, each coaxial line comprising a central inner conductor at least partly surrounded by an outer conductor with insulating air in between the inner and outer conductors. The coaxial lines and the reflector may be formed integrally with each other. Splitting of the inner conductors may be done via crossover connections between inner conductors of adjacent coaxial lines. In order to preserve the characteristic impedance, the lines connecting to the crossover element include impedance matching structures.

Published application number US 2013/01355166 A1 discloses an antenna arrangement comprising an antenna feeding network including at least one antenna feeding line comprising a coaxial line having a central inner conductor and a surrounding outer conductor. The inner conductor is suspended inside the outer conductor with the help of dielectric support means. Published application number US 2013/0135166 A1 suggests use of a crossover element to connect two inner conductors of two adjacent coaxial lines. The crossover element is galvanically connected to the inner conductors by means of, for example, screws, soldering, gluing or a combination thereof, and thus a direct physical contact between the electrically conductive inner conductor and the crossover element is established. Where two conductors need to be connected, the wall between the two coaxial lines is partially or completely removed, and the crossover element is placed in the opening. The antenna arrangement according to published application number US 2013/0135166 has the disadvantage that such an antenna arrangement may be difficult and time consuming to assemble or manufacture. A further disadvantage with this arrangement is that the mechanical connection formed by the screwed, glued or soldered connection between the lines may introduce passive intermodulation (PIM).

SUMMARY OF THE INVENTION

An object of the present invention is to overcome at least some of the disadvantages of the prior art described above.

These and other objects are achieved by the present invention by means of an antenna feeding network comprising at least two coaxial lines and a multi radiator antenna comprising such an antenna feeding network according to the technology described herein.

According to a first aspect of the invention, an antenna feeding network for a multi-radiator antenna is provided, the antenna feeding network comprising at least two coaxial lines. Each coaxial line comprises a central inner conductor and an elongated outer conductor surrounding the central inner conductor. At least a first inner conductor and a second inner conductor of the at least two coaxial lines are indirectly interconnected.

In other words, the antenna feeding network comprises at least a first coaxial line and a second coaxial line, wherein the first coaxial line comprises a first inner conductor and an elongated outer conductor surrounding the first inner conductor, and wherein the second coaxial line comprises a second inner conductor and an elongated outer conductor surrounding the second inner conductor. The first inner conductor, the second inner conductor, and optionally further inner conductors, are indirectly interconnected or interconnectable. The coaxial lines may be parallel.

The invention is based on the insight that an antenna feeding network, which is easy to assemble, yet provides high performance and low passive intermodulation, may be achieved by indirectly interconnecting inner conductors of the coaxial lines instead of connecting the inner conductors galvanically. Such an indirect interconnection, i.e. capacitive or inductive interconnection or a combination of the two, between the lines may provide an interconnection, which does not suffer from the disadvantages associated with mechanical/galvanical connections discussed above.

It is understood that the term coaxial line refers to an arrangement comprising an inner conductor and an outer conductor with insulating or dielectric material or gas there between, where the outer conductor is coaxial with the inner conductor in the sense that the outer conductor completely or substantially surrounds the inner conductor. Thus, the outer conductor does not necessarily have to surround the inner conductor completely, but may be provided with openings or slots, which may even extend along the full length of the outer conductor.

The at least two coaxial lines may each be provided with air between the inner and outer conductors. The air between the inner and outer conductors thus replaces the dielectric often found in coaxial cables.

In embodiments, at least one, or each, coaxial line of the at least two coaxial lines is provided with at least one support element configured to support the central inner conductor, the support element being located between the outer and inner conductors.

In embodiments, at least one, or each, coaxial line of the at least two coaxial lines is furthermore provided with at least one dielectric element to at least partially fill the cavity between the inner and outer conductors. Such dielectric element(s) is/are preferably slidably movable inside the outer conductor(s) to co-operate with the coaxial line(s) to provide a phase shifting arrangement. Phase shifting is achieved by moving the dielectric element that is located between the inner conductor and the outer conductor of the coaxial line. It is a known physical property that introducing a material with higher permittivity than air in a transmission line will reduce the phase velocity of a wave propagating along that transmission line. This can also be perceived as delaying the signal or introducing a phase lag compared to a coaxial line that has no dielectric material between the inner and outer conductors. If the dielectric element is moved in such a way that the outer conductor is filled with more dielectric material, the phase shift increases. The at least one dielectric element may have a U-shaped profile such as to partly surround the inner conductor in order to at least partly fill the cavity between the inner and outer conductors.

In embodiments, two of the at least two coaxial lines form a splitter/combiner. When operating as a splitter, the inner conductor of a first coaxial line is part of the incoming line, and the two ends of the inner conductor of the second coaxial line are the two outputs of the splitter. Thus, the second coaxial line forms two outgoing coaxial lines. In such an embodiment, the dielectric element may be arranged in the second coaxial line in such a way that by moving the dielectric part, different amounts of dielectric material is present in the respective outgoing coaxial lines. Such an arrangement allows the differential phase of the outputs of a splitter to be varied by adjusting the position of the dielectric part within the splitter. A reciprocal functionality is obtained when the coaxial line functions as a combiner. Such splitters/combiners having variable differential phase shifting capability are advantageously used in antennas, having radiators positioned in a vertical column, to adjust the electrical antenna tilt angle by adjusting the relative phases of the signals feeding the radiators.

In embodiments where the coaxial line(s) is/are provided with support element(s), dielectric element(s) or other components inside the outer conductor(s), the coaxial line(s) may be described as substantially air filled because these components occupy part of the space inside the outer conductor, which would otherwise be filled with air.

In embodiments, the antenna feeding network comprises a connector device configured to indirectly interconnect the at least first and second inner conductors.

Herein the word indirectly means that conductive material of the connector device is not in direct physical contact with the conductive material of the first inner is conductor and the second inner conductor, respectively. Indirectly thus means an inductive, a capacitive coupling or a combination of the two.

In embodiments, there may be at least one insulating layer arranged in between the conductive material of the connector device and the conductive material of the inner conductor. This at least one insulating layer may be arranged on the connector device and thus belong to the connector device and/or it may be arranged on the first inner conductor or on the second inner conductor or on both inner conductors. The at least one insulating layer may alternatively comprise a thin film which is arranged between the conductive material of the connector device and the conductive material of the inner conductor. The at least one insulating layer may also be described as an insulating coating. The insulating layer or insulating coating may be made of an electrically insulating material such as a polymer material or a non-conductive oxide material with a thickness of less than 50 μm, such as from 1 μm to 20 μm, such as from 5 μm to 15 μm, such as from 8 μm to 12 μm. Such a polymer or oxide layer may be applied with known processes and high accuracy on the connector device and/or on the inner conductor(s).

In embodiments, the connector device may be configured to be removably connected to the first inner conductor and the second inner conductor. This allows a quick reconfiguration of the antenna feeding network, if necessary or can be used for troubleshooting in antenna production.

In preferred embodiments, the connector device may be realized as a snap-on element comprising at least one pair of snap-on fingers and a bridge portion, whereby the snap-on fingers may be connected to the bridge portion and wherein the snap-on fingers are configured to be snapped onto the first or the second inner conductor. The bridge portion may be configured to connect with the other of the first or the second inner conductor, which is not engaged by the pair of snap-on fingers, when the snap-on element is snapped onto the first or second inner conductor. The snap-on element may comprise two pairs of snap-on fingers which are connected by the bridge portion, wherein the two pairs of snap-on fingers may be configured to be snapped onto the first inner conductor and the second inner conductor, respectively. These preferred embodiments are advantageous since they allow convenient assembly of the antenna feeding network, where the connector device is simply snapped onto the first and/or second inner conductors. The connector device may also be arranged with two or more bridge portions, connecting three or more pairs of snap-on fingers.

In an alternative embodiment, one of the inner conductors comprises a cavity and another of the inner conductors comprises a rod-shaped protrusion configured to extend into and engage with the cavity. An insulating layer is provided in the cavity and/or on the rod-shaped protrusion, or alternatively, an insulating layer is provided as an insulating film between the cavity and the rod-shaped protrusion. Thus, an indirect connection may be provided between two inner conductors. These embodiments are advantageous since they allow convenient assembly of the antenna feeding network, where the inner conductors are interconnected simply by pushing the rod-shaped protrusion into the cavity. Also, this arrangement will reduce the risk for PIM. The cavity may have a depth corresponding to a quarter wavelength.

In yet an alternative embodiment, the connector device comprises at least two engaging portions. Each of the at least first and second inner conductors comprises corresponding engaging portions, each adapted to engage with a corresponding engaging portion of the connector device. The engaging portion is in the form of a cavity or rod-shaped protrusion. An insulating layer is provided in the cavity and/or on the rod-shaped protrusion, or alternatively, an insulating layer is provided as an insulating film between the cavity and the rod-shaped protrusion. Thus, an indirect connection may be provided between two inner conductors. The connector device may in embodiments be provided with three legs, each being provided with an engaging portion at its end to interconnect three inner conductors. For example, the connector device may be provided with cavities at each end of the legs, and three inner conductors may be provided with rod-shaped protrusions adapted to fit and engage in a respective cavity. The cavity or cavities may have a depth corresponding to a quarter wavelength. The connector device may also be arranged such as to connect four or more inner conductors.

The embodiments described above may be combined in any practically realizable way.

According to a second aspect of the invention, a multi radiator base station antenna is provided, in which the antenna comprises an electrically conductive reflector, at least one radiating element arranged on the reflector and an antenna feeding network as described above.

In an embodiment of the multi-radiator antenna according to the second aspect of the invention, the electrically conductive reflector may comprise at least one opening; the opening may be located on either the front side or the back side of the reflector, so that the connector device can be installed on the first and second inner conductor via the opening. The opening may advantageously be adapted to the size of the connector device. An opening may be assigned to each inner conductor pair of the antenna feeding network so that all inner conductors in the electrically conductive reflector may be connected by connector devices.

According to a third aspect of the invention, a method for assembling an antenna feeding network for a multi-radiator antenna is provided. The method comprises providing at least two coaxial lines, wherein each coaxial line is provided with a central inner conductor and an elongated outer conductor surrounding the central inner conductor and interconnecting at least two inner conductors of the coaxial lines indirectly.

In an embodiment of the method according to the third aspect of the invention, the method further comprises providing a connector device, and providing an to insulating layer on the connector device and/or on the at least first and second conductors. Alternatively, an insulating layer is provided between the connector device and the at least first and second conductors. The embodiment further comprises connecting the connector device between the at least first and second inner conductors, wherein the connector device preferably is realized as a snap-on is element comprising snap-on fingers adapted to be snapped onto the at least first and second inner conductors.

In embodiments of a method according the third aspect of the invention, the method provides for assembling an antenna feeding network according to the first aspect of the invention or embodiments thereof. Embodiments of the method comprises performing steps to achieve features corresponding to any of the above described embodiments of the antenna feeding network.

BRIEF DESCRIPTION OF THE DRAWINGS

The present invention will now be described, for exemplary purposes, in more detail by way of embodiments and with reference to the enclosed drawings, in which.

DETAILED DESCRIPTION OF PREFERRED EMBODIMENTS

Figure 1:
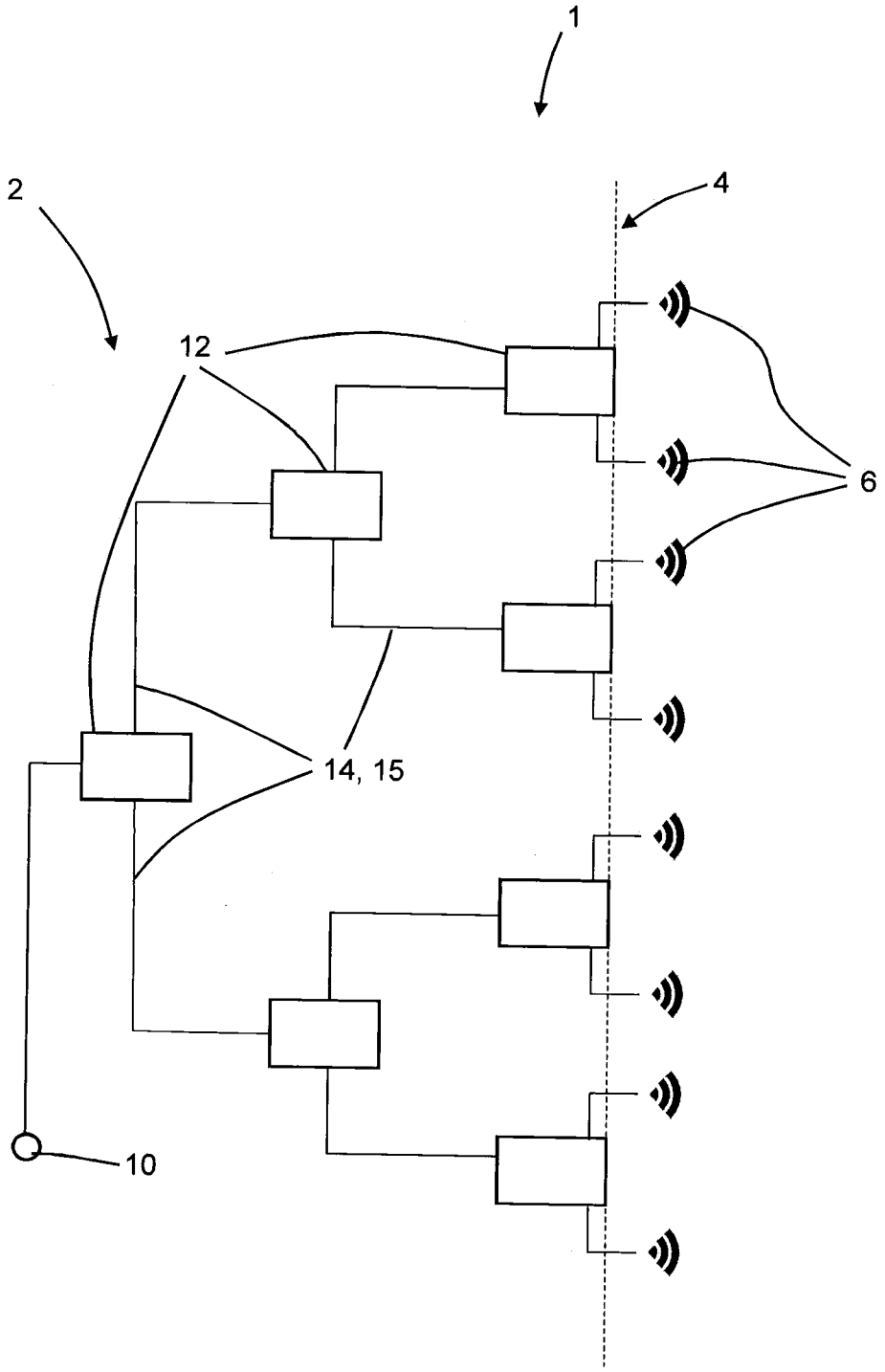
FIG. 1 schematically illustrates a multi-radiator antenna.

FIG. 1 schematically illustrates an antenna arrangement 1 comprising an antenna feeding network 2, an electrically conductive reflector 4, which is shown schematically in FIG. 1, and a plurality of radiating elements 6. The radiating elements 6 may be dipoles.

Figure 2:
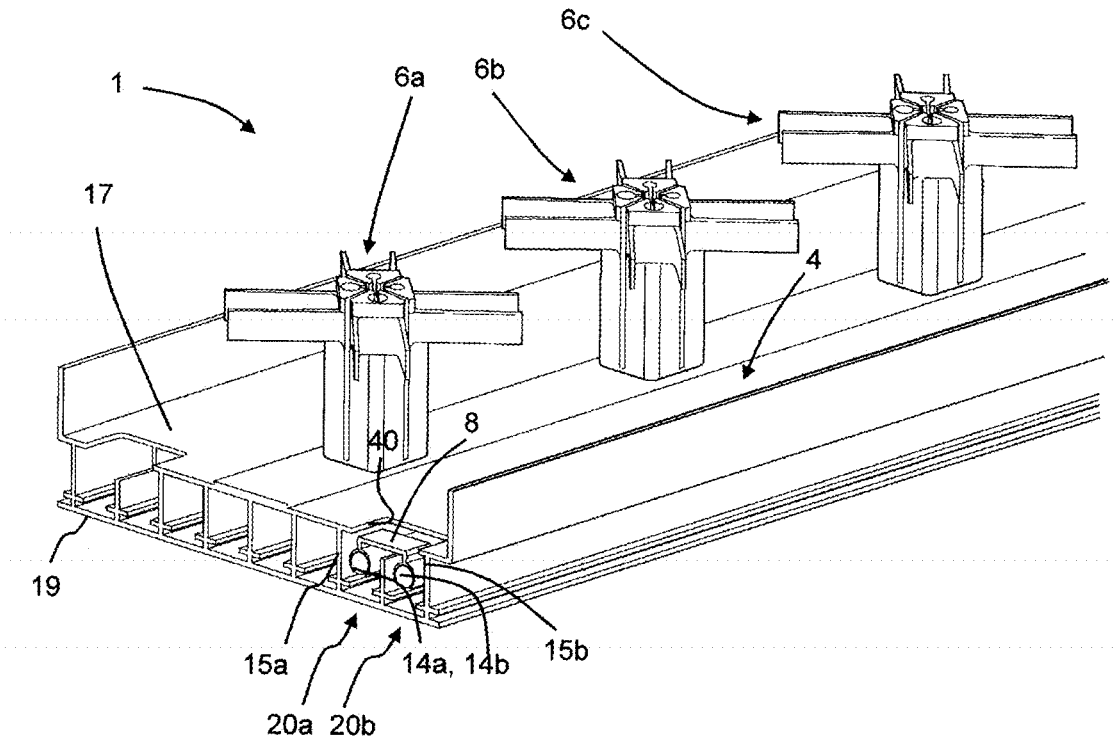
FIG. 2 schematically illustrates a perspective view of an embodiment of a multi-radiator antenna according to a second aspect of the invention.

The antenna feeding network 2 connects a coaxial connector 10 to the plurality of radiating elements 6 via a plurality of lines 14, 15, which may be coaxial lines, which are schematically illustrated in FIG. 1. The signal to/from the connector 10 is split/combined using, in this example, three stages of splitters/combiners 12. Turning now to FIG. 2, which illustrates a multi-radiator antenna 1 in a perspective view, the antenna 1 comprises the electrically conductive reflector 4 and radiating elements 6*a*, 6*b*, and 6*c*.

The electrically conductive reflector 4 comprises a front side 17, where the radiating elements 6*a*-6*c* are mounted and a back side 19.

FIG. 2 shows a first coaxial line 20*a* which comprises a first central inner conductor 14*a*, an elongated outer conductor 15*a* forming a cavity or compartment around the central inner conductor, and a corresponding second coaxial line 20*b* having a second inner conductor 14*b* and an elongated outer conductor 15*b*. The outer conductors 15*a*, 15*b* have square cross sections and are formed integrally and in parallel to form a self-supporting structure. The wall which separates the coaxial lines 20*a*, 20*b* constitute vertical parts of the outer conductors 15*a*, 15*b* of both lines. The first and second outer conductors 15*a*, 15*b* are formed integrally with the reflector 4 in the sense that the upper and lower walls of the outer conductors are formed by the front side 17 and the back side 19 of the reflector, respectively.

Although the first and second inner conductors 14*a*, 14*b* are illustrated as neighboring inner conductors they may actually be further apart thus having one or more coaxial lines, or empty cavities or compartments, in between.

In FIG. 2, not all longitudinal channels or outer conductors are illustrated with inner conductors, it is however clear that they may comprise such inner conductors.

The front side 17 of the reflector comprises at least one opening 40 for installation of a connector device 8. The opening 40 extends over the two neighboring coaxial lines 20*a*, 20*b* so that the connector device 8 can engage the first and second inner conductors 14*a*, 14*b*.

Although the invention is illustrated with two neighboring inner conductors 14*a*, 14*b*, alternative embodiments have an opening (not shown) that extends across more than two coaxial lines 20*a*, 20*b* and provide a connector device 8 than can bridge two or even more inner conductors. Such a connector device (not shown) may thus be designed so that the connector device extends over a plurality of coaxial lines between two inner conductors or over empty cavities or compartments. Such a connector device (not shown) may also be used to connect three or more inner conductors.

Figure 3:
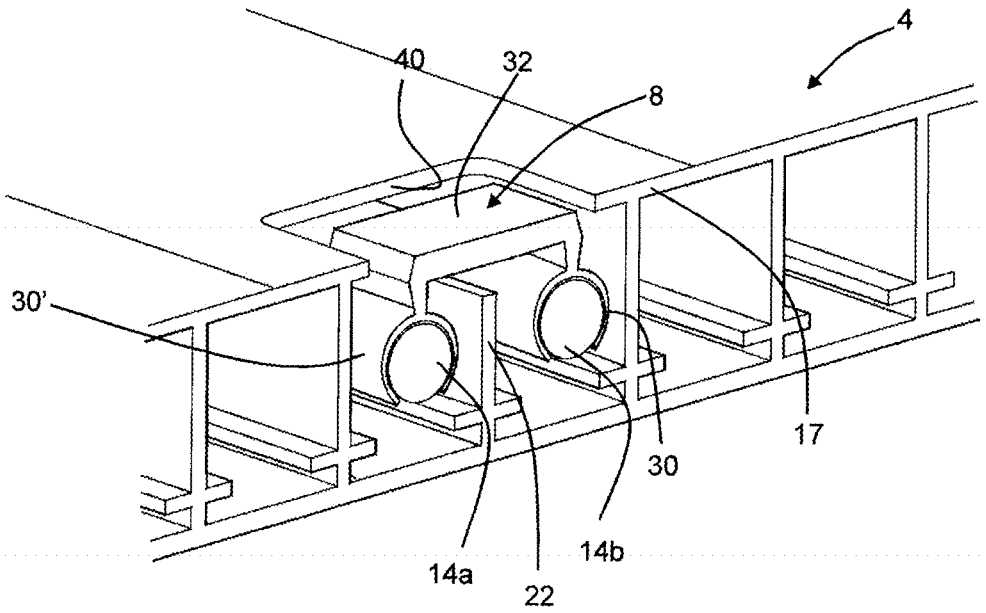
FIG. 3 schematically illustrates a perspective view of an embodiment of an antenna feeding network according to a first aspect of the invention.

In FIG. 3, an enlarged view of the opening 40 and the connector device 8 arranged therein is illustrated. The connector device 8 is clipped or snapped onto the first inner conductor 14*a* and the second inner conductor 14*b* thereby providing a removable connection between the first inner conductor and the second inner conductor. The connection between the first inner conductor 14*a* and the second inner conductor 14*b* is electrically indirect, which means that it is either capacitive, inductive or a combination thereof. This is achieved by providing a thin insulating layer of a polymer material or some other insulating material (e.g., a non-conducting oxide) on the connector device 8. The insulating layer may have a thickness of 1 μm to 20 μm, such as from 5 μm to 15 μm, such as from 8 μm to 12 μm, or may have a thickness of 1 μm to 5 μm. The insulating layer may cover the entire outer surface of the connector device 8 or at least the portions of the connector device 8 that engage the first and second inner conductors 14*a*, 14*b*.

The connector device 8 comprises a bridge portion 32 and two pairs of snap-on fingers 30, 30'. One of the two pairs of snap-on fingers 30' is arranged close to one end of the bridge portion 32 and the other of the two pairs of snap-on fingers 30 is arranged close to the other end of the bridge portion 32. The two pairs of snap-on fingers 30, 30' may be connected to the bridge portion 32 via connecting portions configured such that the bridge portion 32 is distanced from the first and second inner conductors 14*a*, 14*b*. In other embodiments, the snap-on fingers 30, 30' are connected directly to the bridge portion 32. The connecting portions, as well as the other portions of the connector device, are shaped to optimize the impedance matching of the splitter/combiner formed by the connector device and the coaxial lines. The shape, or preferably the diameter of the connecting inner conductors may also contribute to the matching of the splitter/combiner.

As can be seen from FIG. 3, the vertical separating wall portion 22 is reduced to about two-thirds to three-quarters of its original height in the area of the opening 40 so that the connector device 8 does not protrude over the front side 17 of the electrically conductive reflector 4. In other embodiments, the wall portion 22 is reduced all the way to the floor of the outer conductors. The remaining height of the wall portion is adapted together with the other components, such as the connector device to optimize the impedance match.

It may be possible (not shown in the figures) to provide only one pair of snap-on fingers, for example the pair of snap-on fingers 30' engaging the first inner conductor 14*a* providing an indirect connection, and to contact directly the other end of the bridge portion 32 to the second inner conductor 14*b* without insulating layer or coating. Such a direct connection can be provided by connecting the bridge portion 32 to inner conductor 14*b* by means of a screw connection, by means of soldering, by making the bridge portion an integral part of inner conductor 14*b*, or by some other means providing a direct connection.

Figure 4:
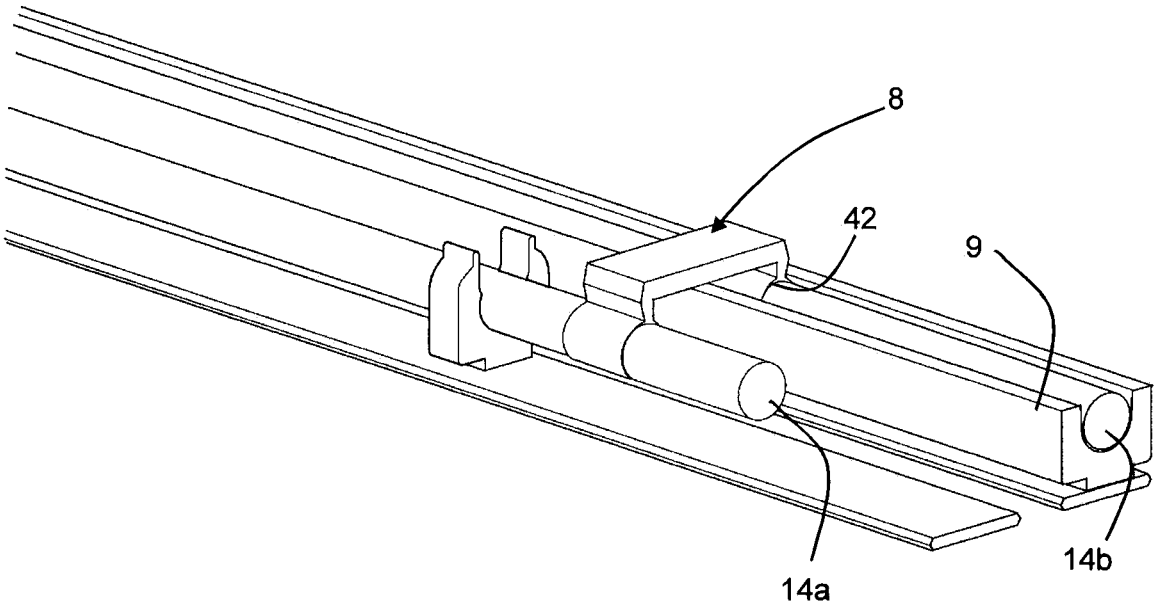
FIG. 4 schematically illustrates another perspective view of parts of an embodiment of an antenna feeding network according to the first aspect of the invention.

FIG. 4 shows another view of parts of an embodiment of the antenna feeding network. The connector device 8 engages the first and second inner conductors 14*a*, 14*b*. The connector device 8 and the inner conductors 14*a*, 14*b* together form a splitter/combiner. When operating as a splitter, the inner conductor 14*a* is part of the incoming line, and the two ends of the inner conductor 14*b* are the two outputs of the splitter. The U-shaped dielectric element 9 can be moved along the inner conductor 14*b*, which, together with an outer conductor (not shown), forms first and second coaxial output lines on opposite sides of the connector device 8. The dielectric element, thus, has various positions along those coaxial output lines.

First, consider the case when the dielectric element 9 is placed in a central position, equally filling the first and second output coaxial lines. When a signal is received at the input coaxial line 14*a*, the signal is divided between the first output coaxial line and the second output coaxial line, and the signals outputted from the two output coaxial lines is equal in phase. If the dielectric element 9 is moved in such a way that the first output coaxial line is filled with more dielectric material than the second output coaxial line, the phase shift from the input to the first output increases. At the same time the second output coaxial line would be filled with less dielectric material, and the phase shift from the input to the second output decreases. Hence, the phase at the first output lags the phase at the second output. If the dielectric element is moved in the opposite direction, the phase of the first output leads the phase of the second output. The splitter/combiner may thus be described as a differential phase shifter.

FIG. 4 illustrates how the connector device 8 engages the first and second inner conductors 14*a*, 14*b* in circumferential recessed areas or grooves 42 of the first and second inner conductors 14*a*, 14*b*. These grooves may be used to position the connector device 8 correctly along the longitudinal direction of the inner conductors 14*a*, 14*b*.

Figure 5:
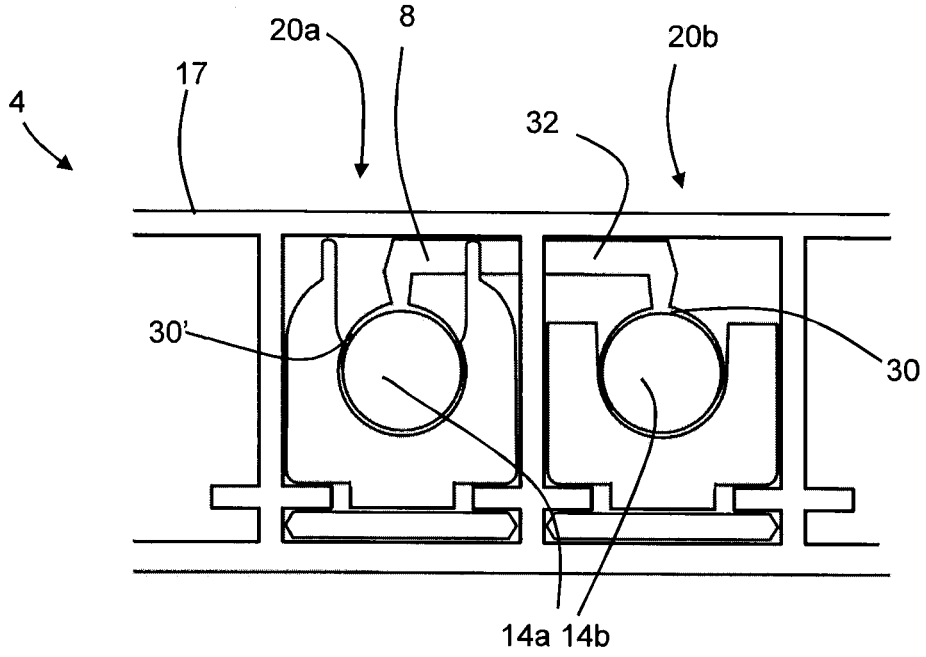
FIG. 5 schematically illustrates a front view into two neighboring coaxial lines of an embodiment of an antenna feeding network according to the first aspect of the invention.

FIG. 5 illustrates a view into the first and second coaxial lines 20*a*, 20*b* where the connector device 8, bridging the first inner conductor 14*a* and the second inner conductor 14*b* is visible. The snap-on fingers 30, 30' are not so well visible since the snap-on fingers 30, 30' engage the first and second inner conductors 14*a*, 14*b* in areas with a smaller diameter than the rest of the first and second inner conductors 14*a*, 14*b*. FIG. 5 further illustrates that the bridge portion 32 is not extending beyond the front side 17 of the electrically conductive reflector 4.

The embodiment of the connector device 8 has been described having a thin insulating layer on the connector device 8. It may however be possible to provide the first and second inner conductors 14*a*, 14*b* respectively with a very thin insulating layer of a polymer material and provide the connector device without any insulating layer. The insulating layer may cover the entire outer surface of the first and second inner conductors 14*a*, 14*b*, or at least the portions where snap-on fingers 30, 30' of the connector device 8 engage the first and second inner conductors 14*a*, 14*b*. In other embodiments, an isolating material in the form of a thin foil is placed between the snap-on fingers 30, 30' and the inner conductor 14.

Further, the connector device 8 has been described illustrating a first and a second inner conductor 14*a*, 14*b* in the antenna arrangement 1 (FIG. 1). The antenna arrangement 1 may however comprise more than one connector device 8 and a plurality of inner conductors 14*a*, 14*b*.

Figure 6:
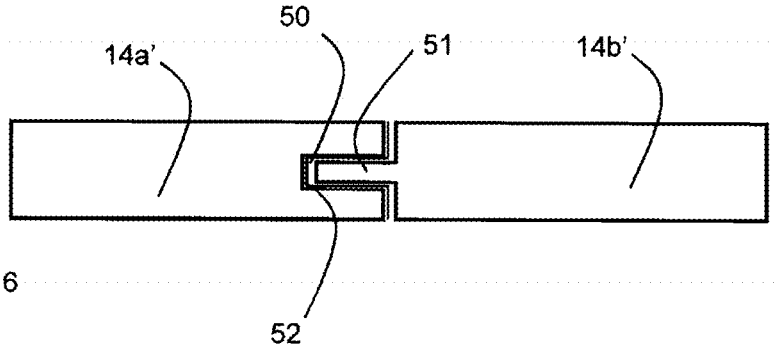
FIG. 6 schematically illustrates parts of another embodiment of an antenna feeding network according to the first aspect of the invention.

FIG. 6 schematically illustrates parts of another embodiment of an antenna feeding network according to the first aspect of the invention. In FIG. 6, a cross section view is shown of a first inner conductor 14*a'* and a second inner conductor 14*b'*. The first inner conductor 14*a'* comprises a cavity 50 extending axially into one end of the first inner conductor 14*a'*. The second inner conductor 14*b'* comprises a rod-shaped protrusion 51 extending axially from one end of the second inner conductor 14*b'*. The protrusion 51 is adapted to extend into the cavity 50 of the first inner conductor. An insulating layer 52 is provided in and around the cavity to provide an indirect electrical connection between the conductors. In other embodiments, the insulating layer may be provided on the protrusion 51 or as a separate insulating film between the conductors. The insulating layer may be provided as a polymer material or some other insulating material (e.g., a non-conducting oxide) on either or both inner conductors 14*a'* or 14*b'*, completely or partially covering inner conductors 14*a'* or 14*b'*, or the insulating material may be provided as a thin insulating foil inserted between inner conductors 14*a'* and 14*b'*.

Figure 7:
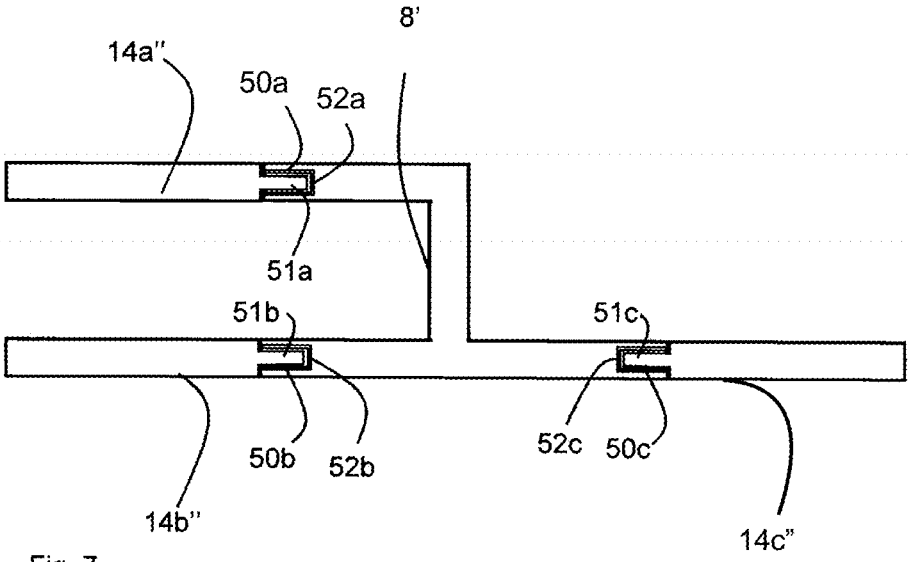
FIG. 7 schematically illustrates parts of yet another embodiment of an antenna feeding network according to the first aspect of the invention.

FIG. 7 schematically illustrates parts of yet another embodiment of an antenna feeding network according to the first aspect of the invention. In FIG. 7, a cross section view is shown of three inner conductors 14*a*", 14*b*" and 14*c*" and a three-legged h-shaped connector device 8'. Each leg of the connector device 8' is provided with a cavity 50*a*, 50*b*, and 50*c* extending axially into respective leg ends. The inner conductors 14*a*", 14*b*", and 14*c*'" each comprises a rod-shaped protrusion 51*a*, 51*b* and 51*c* extending axially from one end of the inner conductors 14*a*", 14*b*", and 14*c*". The protrusions 51*a*, 51*b*, and 51*c* extend into corresponding cavities 50*a*, 50*b*, and 50*c* of the connector device. Insulating layers 52*a*, 52*b*, and 52*c* are provided in and around the cavities to provide an indirect electrical connection between the conductors. In other embodiments, the insulating layers may be provided on the protrusions, or as separate insulating films between the conductors and the connector device. The h-shaped connector device 8' may be mounted in a similar manner as the connector device 8, i.e. by reducing a separating wall between two adjacent outer conductors. In other embodiments, the connector device 8' is provided with protrusions, and the inner conductors 14*a*", 14*b*", and 14*c*" are provided with cavities.

The description above and the appended drawings are to be considered as non-limiting examples of the invention. The person skilled in the art realizes that several changes and modifications may be made within the scope of the invention. For example, the number of coaxial lines may be varied and the number of radiators/dipoles may be varied. Furthermore, the shape of the connector element (if any) and inner conductors and the placement of the insulating layer or coating may be varied. Furthermore, the reflector does not necessarily need to be formed integrally with the coaxial lines or may, on the contrary, be a separate element. The scope of protection is determined by the appended patent claims.

The invention claimed is:

1. An antenna feeding network for a multi-radiator antenna, the antenna feeding network comprising at least two coaxial lines, wherein each coaxial line comprises an inner conductor and an outer conductor, which is elongated and which surrounds the inner conductor, further comprising at least one connector device configured to indirectly interconnect at least the inner conductor of a first of said at least two coaxial lines and the inner conductor of a second of said at least two coaxial lines, wherein the at least one connector device is realized as a snap-on element comprising at least one pair of snap-on fingers and a bridge portion, wherein the snap-on fingers of said at least one pair of snap-on fingers of said at least one connector device are connected to the bridge portion and wherein the snap-on fingers of said at least one pair of snap-on fingers of said at least one connector device are adapted to be snapped onto the inner conductor of said first of said at least two coaxial lines or the second inner conductor of said second of said at least two coaxial lines, whereby the connector device is configured to be removably connected to the first inner conductor of said first of said at least two coaxial lines and the inner conductor of said second of said at least two coaxial lines, respectively.

2. The antenna feeding network according to claim 1, wherein the at least two coaxial lines are substantially air-filled coaxial lines, each coaxial line being provided with air between the inner and outer conductors.

3. The antenna feeding network according to claim 1, wherein said at least one connector device provides a capacitive or inductive connection between the inner conductor of said first of said at least two coaxial lines and the inner conductor of said second of said at least two coaxial lines, respectively.

4. The antenna feeding network according to claim 1, comprising at least one insulating layer, wherein the at least one insulating layer is arranged on the at least one connector device or on the first inner conductor of said first of said at least two coaxial lines or the inner conductor of said second of said at least two coaxial lines, respectively.

5. The antenna feeding network according to claim 1, comprising at least one insulating layer, wherein the at least one insulating layer is arranged between the at least one connector device and the inner conductor of said first of said at least two coaxial lines or the inner conductor of said second of said at least two coaxial lines, respectively.

6. The antenna feeding network according to claim 1 wherein said at least one pair of snap-on fingers and said bridge portion each comprises a core made of an electrically conductive material and an electrically insulating layer arranged around the core.

7. The antenna feeding network according to claim 6, wherein the insulating layer is a polymer layer or a non-conductive oxide material with a thickness of less than or equal to 50 μm.

8. The antenna feeding network according to claim 6, wherein the insulating layer is a polymer layer or a non-conductive oxide material with a thickness of at least 1 μm and no more than 20 μm.

9. The antenna feeding network according to claim 1, wherein said at least one pair of snap on fingers comprises at least two pairs of snap on fingers, wherein a first of the at least two pairs of snap on fingers of said at least one connector device are configured to be snapped onto the inner conductor of said first of said at least two coaxial lines and a second of said at least two pairs of snap on fingers are configured to be snapped onto the inner conductor of said second of said at least two coaxial lines, respectively.

10. A method for assembling an antenna feeding network for a multi-radiator antenna, said method comprising:

providing at least two coaxial lines, wherein each coaxial line is provided with an inner conductor and an outer conductor, which is elongated and which surrounds the inner conductor;

interconnecting at least the inner conductor of a first of said at least two coaxial lines and the inner conductor of a second of said at least two coaxial lines indirectly by connecting at least one connector device between said said inner conductors of said at least first and second of said at least two coaxial lines, wherein said least one connector device is realized as a snap-on element comprising at least one pair of snap-on fingers and a bridge portion, wherein the snap-on fingers of said at least one pair of snap-on fingers of said at least one connector device are connected to the bridge portion and wherein the snap-on fingers of said at least one pair of snap-on fingers of said at least one connector device are adapted to be snapped onto the inner conductors of said at least first or second of said at least two coaxial lines, whereby, the at least one connector device is adapted to be removably connected to the inner conductor of said first of said at least two coaxial lines and the inner conductor of said second of said at least two coaxial lines, respectively; and providing an insulating layer on said at least one connector device and/or on said inner conductors of said at least first and second of said at least two coaxial lines or providing said insulating layer between said at least one connector device and the inner conductor of said first of said at least two coaxial lines and the inner conductor of said second of said at least two coaxial lines, respectively.

11. The method according to claim 10, wherein said insulating layer is achieved by providing a thin insulating layer on the at least one connector device.

12. The method according to claim 10, wherein said insulating layer is achieved by providing a thin insulating layer on the inner conductors of said first and second of said at least two coaxial lines, respectively.

13. A multi radiator antenna comprising an electrically conductive reflector, at least one radiating element arranged on said reflector and an antenna feeding network, said at least one radiating element being connected to said antenna feeding network, said antenna feeding network comprising at least two coaxial lines, wherein each coaxial line comprises an inner conductor and an outer conductor, which is elongated and which surrounds the inner conductor, further comprising at least one connector device configured to indirectly interconnect at least the inner conductor of a first of said at least two coaxial lines and the inner conductor of a second of said at least two coaxial lines, wherein the at least one connector device is realized as a snap-on element comprising at least one pair of snap-on fingers and a bridge portion, whereby the snap-on fingers of said at least one pair of snap-on fingers of said at least one connector device are connected to the bridge portion and wherein the snap-on fingers of said at least one pair of snap-on fingers of said at least one connector device are adapted to be snapped onto the inner conductor of said first of said at least two coaxial lines or the inner conductor of said second of said at least two coaxial lines, whereby the at least one connector device is configured to be removably connected to the first inner conductor of said first of said at least two coaxial lines and the inner conductor of said second of said at least two coaxial lines, respectively.

14. The multi radiator antenna according to claim 13, further comprising an insulating layer which is is a polymer material or a non-conductive oxide material with a thickness of at least 1 μm and no more than 20 μm.

15. The multi radiator antenna according to claim 13, wherein the electrically conductive reflector comprises at least one opening adapted to the size of the at least one connector device such that said at least one connector device can be installed via said opening.

16. The multi radiator antenna according to claim 15, wherein the at least one opening is located on a front side of said electrically conductive reflector.

17. The multi radiator antenna according to claim 15, wherein the at least one opening is located on a back side of said electrically conductive reflector.

18. The multi radiator antenna according to claim 13, wherein the at least two coaxial lines are each substantially air-filled coaxial lines, each coaxial line being provided with air between the inner and outer conductors.

19. The multi radiator antenna according to claim 13, wherein said at least first and second inner conductors are interconnected capacitively and/or inductively.

20. The multi radiator antenna according to claim 13, comprising at least one insulating layer, wherein the at least one insulating layer is arranged on the at least one connector device and/or on the inner conductor of said first of said at least two coaxial lines or the inner conductor of said second of said at least two coaxial lines, respectively.

21. The multi radiator antenna according to claim 13, comprising at least one insulating layer, wherein the at least one insulating layer is arranged between the at least one connector device and the first inner conductor of said first of said at least two coaxial lines or the inner conductor of said second of said at least two coaxial lines, respectively.

22. The multi radiator antenna according to claim 13, wherein said at least one pair of snap-on fingers, and said bridge portion each comprises a core made of an electrically conductive material and an electrically insulating layer arranged around the core.

23. The multi radiator antenna according to claim 13, further comprising an insulating layer which is is a polymer material or a non-conductive oxide material with a thickness of less than or equal to 50 μm.

24. The multi radiator antenna according to claim 13, wherein said at least one pair of snap on fingers comprises at least two pairs of snap on fingers, wherein a first of the at least two pairs of snap on fingers of said at least one connector device are configured to be snapped onto the inner conductor of said first of said at least two coaxial lines and a second of said at least two pairs of snap on fingers are configured to be snapped onto the second inner conductor of said second of said at least two coaxial lines, respectively.

* * * * *